US011045005B2

(12) United States Patent
Harguth et al.

(10) Patent No.: US 11,045,005 B2
(45) Date of Patent: Jun. 29, 2021

(54) STACKABLE ACTIVE SEAT

(71) Applicant: The Prophet Corporation, Owatonna, MN (US)

(72) Inventors: Alison Marie Harguth, Owatonna, MN (US); Amber Lee Orenstein, Prior Lake, MN (US); Jason J. Ness, Victoria, MN (US); Louis Polk, St. Louis Park, MN (US)

(73) Assignee: The Prophet Corporation, Owatonna, MN (US)

( * ) Notice: Subject to any disclaimer, the term of this patent is extended or adjusted under 35 U.S.C. 154(b) by 0 days.

(21) Appl. No.: 16/431,401

(22) Filed: Jun. 4, 2019

(65) Prior Publication Data

US 2020/0383488 A1 Dec. 10, 2020

(51) Int. Cl.

| | |
|---|---|
| ***A47C 9/00*** | (2006.01) |
| ***A47C 3/029*** | (2006.01) |
| ***A47C 3/04*** | (2006.01) |

(52) U.S. Cl.

CPC ..... *A47C 9/002* (2013.01); *A47C 3/029* (2013.01); *A47C 3/04* (2013.01)

(58) Field of Classification Search

CPC ..... A47C 3/029; A47C 9/002; A47C 3/04; A47C 3/02; A47C 7/004; A47C 9/025; A47D 13/10

USPC ..... 297/271.5, 451.4, 451.5, 451.6, 451.12, 297/195.11, 452.41, 239, 258.1, 4; 472/102

See application file for complete search history.

(56) References Cited

U.S. PATENT DOCUMENTS

| | | | | |
|---|---|---|---|---|
| 304,435 | A * | 9/1884 | Malick | A47C 3/029 297/133 |
| 759,809 | A * | 5/1904 | Farley | A47C 9/027 297/4 |
| 2,049,539 | A * | 8/1936 | Greenwood | A47C 9/02 248/152 |
| 2,552,693 | A | 5/1951 | Smith | |
| 2,623,633 | A | 12/1952 | Bladow | |
| 2,742,953 | A | 4/1956 | Kudrna | |
| D198,679 | S | 7/1964 | Cartner | |
| 3,312,437 | A | 4/1967 | Barth | |
| 3,563,605 | A | 2/1971 | Pinkas | |
| 3,604,749 | A | 9/1971 | Parmett et al. | |

(Continued)

FOREIGN PATENT DOCUMENTS

| | | | | |
|---|---|---|---|---|
| DE | 3519676 | A1 * | 12/1986 | A61G 5/1091 |
| DE | 19641159 | A1 * | 1/1998 | A47C 9/025 |
| JP | 8-112155 | A | 5/1995 | |

OTHER PUBLICATIONS

Plastic Round Stools, Retrieved May 2, 2018 from URL: <http://www.umaplastics.com/plastic-round-stools.html>, 5 pages.

(Continued)

*Primary Examiner* — Milton Nelson, Jr.
(74) *Attorney, Agent, or Firm* — Merchant & Gould P.C.

(57) ABSTRACT

An active seat includes a seat disposed at a first end of a body; a convex surface disposed at a second end of the body; and a stacking notch defined at an intermediate location along the body. The convex surface defines at least a first rocking path about which the active seat tilts. The stacking notch defines a flat surface recessed laterally inwardly from an outer periphery of the body taken at the first and second ends.

21 Claims, 8 Drawing Sheets

(56) References Cited

U.S. PATENT DOCUMENTS

| | | | | |
|---|---|---|---|---|
| D228,095 | S | 8/1973 | Schmitt | |
| 3,751,845 | A | 8/1973 | van Leeuwen | |
| D232,499 | S | 8/1974 | Martinelli | |
| D232,504 | S | 8/1974 | Archinal | |
| D234,933 | S | 4/1975 | Burke | |
| 4,050,736 | A * | 9/1977 | Karp | A47C 3/04 297/135 |
| 4,084,273 | A | 4/1978 | Haynes | |
| 4,232,901 | A | 11/1980 | Harrington et al. | |
| 4,451,080 | A * | 5/1984 | Nix | A61H 3/00 135/84 |
| 4,845,881 | A | 7/1989 | Ward | |
| 5,112,103 | A | 5/1992 | Downer | |
| 5,226,865 | A | 7/1993 | Chin | |
| 5,632,524 | A * | 5/1997 | Ikeda | A47C 7/024 297/233 |
| 6,000,750 | A * | 12/1999 | Rossman | A47D 1/004 108/11 |
| D459,598 | S * | 7/2002 | Andersen | D6/349 |
| D460,641 | S | 7/2002 | O'Hare et al. | |
| D498,067 | S | 11/2004 | Van Dyke | |
| 6,834,916 | B2 * | 12/2004 | Volkman | A47C 3/029 297/270.1 |
| D557,909 | S * | 12/2007 | LaSorsa | D6/349 |
| 7,325,872 | B2 * | 2/2008 | Basu | A63G 13/02 297/217.4 |
| 7,341,314 | B1 | 3/2008 | Boyd | |
| D579,675 | S | 11/2008 | Paterson | |
| D586,574 | S | 2/2009 | Gomree | |
| D625,931 | S | 10/2010 | Estrup | |
| D647,313 | S | 10/2011 | Chen | |
| D650,184 | S | 12/2011 | Hsu | |
| D653,059 | S * | 1/2012 | Birch | D6/708.17 |
| D670,094 | S | 11/2012 | Prestandrea et al. | |
| D671,757 | S | 12/2012 | Walker et al. | |
| 8,764,116 | B2 | 7/2014 | Weber et al. | |
| D728,951 | S | 5/2015 | Yoshida | |
| 9,010,867 | B2 | 7/2015 | Kammeyer | |
| 9,138,058 | B2 | 9/2015 | Koolhaas et al. | |
| D740,041 | S | 10/2015 | Chadwick et al. | |
| 9,167,899 | B2 | 10/2015 | Jackson | |
| 9,301,619 | B2 * | 4/2016 | Verdier | A47C 3/22 |
| D756,139 | S * | 5/2016 | Chadwick | D6/352 |
| D767,290 | S | 9/2016 | Walser | |
| 9,567,135 | B1 | 2/2017 | Spadaccini | |
| D788,584 | S | 6/2017 | Chen et al. | |
| D791,523 | S | 7/2017 | Bernard | |
| D809,309 | S | 2/2018 | Theesfeld | |
| D809,310 | S | 2/2018 | Mathur et al. | |
| D809,809 | S | 2/2018 | Theesfeld et al. | |
| D812,919 | S | 3/2018 | Kim | |
| 9,931,556 | B2 * | 4/2018 | Cosma | A63B 69/04 |
| 9,974,391 | B2 | 5/2018 | Wan | |
| D829,014 | S | 9/2018 | Handler et al. | |
| D830,710 | S | 10/2018 | Harguth et al. | |
| D843,745 | S | 3/2019 | Walser | |
| 10,258,160 | B2 | 4/2019 | Risdall et al. | |
| D852,522 | S * | 7/2019 | Bremer | D6/349 |
| D853,740 | S | 7/2019 | Corey et al. | |
| 10,390,629 | B2 * | 8/2019 | Phillips | A47D 1/04 |
| 10,517,399 | B2 | 12/2019 | Harguth et al. | |
| D878,067 | S | 3/2020 | You et al. | |
| D879,486 | S | 3/2020 | Pratt | |
| 2008/0265631 | A1 | 10/2008 | Quicoy | |
| 2010/0066139 | A1 | 3/2010 | Woodring | |
| 2010/0244501 | A1 | 9/2010 | Chiang | |
| 2011/0221255 | A1 * | 9/2011 | Weber | A47C 9/002 297/452.21 |
| 2019/0098998 | A1 | 4/2019 | Harguth et al. | |
| 2020/0022499 | A1 | 1/2020 | Davidson | |

OTHER PUBLICATIONS

Play with a Purpose Catalog; Spring 2017; © 2017 Gopher Sport; 4 pages.

Thick plastic small round stools, home adult children bathroom stool, changing his shoes stool, Retrieved May 2, 2018 from URL: <https://www.aliexpress.com/item/Thick-plastic-small-round-stools-home-adult-children-bathroom-stool-changing-his-shoes-stoo1/32507580751.html, 17 pages.

TiltED Active Seats, Retrieved May 2, 2018 from URL: https://www.gophersport.com/pe/active-classroom/tilted-active-seats?item =25259&pt_source=googleads&pt_med i um =cpc&pt_campaign=Shopping_-_%E2%80%A6, 2 pages.

SmartSeat Stools Moving Minds. [online] Retrieved May 6, 2020 from URL: https://www.moving-minds.com/classroom/seating/smartseat-stool, 3 pages.

Design U.S. Appl. No. 29/693,686, filed Jun. 4, 2019.

* cited by examiner

STACKABLE ACTIVE SEAT

BACKGROUND

Active seating allows a user freedom of movement while remaining seated. For example, a user may be able to pivot, rotate, or otherwise move the seat while sitting in the seat. Other seating includes pedals or other structures that can be moved by the user while the user remains seated. Improvements are desired.

SUMMARY

Some aspects of the disclosure are directed to an active seat allowing a user to tilt in one or more directions. For example, such an active seat could be used in a classroom setting, a daycare, or at home. Two or more active seats can easily stack together for compact storage.

In certain implementations, an active seat includes a seat disposed at a first end of a body; a convex surface disposed at a second end of the body; and a stacking notch defined at an intermediate location along the body between the first and second ends. The convex surface defines at least a first rocking path about which the active seat tilts.

In certain examples, the stacking notch defines a flat surface extending along part of the length of the body.

In certain examples, the flat surface is recessed laterally inwardly from an outer periphery of the body taken at the first and second ends.

In certain examples, the convex surface defines a plurality of rocking paths. In an example, at least one of the rocking paths is rotationally offset from another of the rocking paths. In an example, at least one of the rocking paths is laterally offset from another of the rocking paths.

In some examples, the active seat is monolithically formed. In other examples, at least the convex surface is formed from a separate piece than the seat. In certain examples, the active seat is fabricated from a first monolithically-formed body defining the seat and the stacking notch and from a plate coupled to the body.

In certain implementations, multiple active seats can be stored in a stacked configuration. For example, adjacent active seats are oriented at 90 degree rotational offsets from each other while aligning the flat surfaces to oppose each other. In certain examples, the active seats define resting surfaces that contact either the floor or resting surface of a supporting active seat to enhance stability of the stack.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

The present disclosure is directed to a stackable active seat.

Figure 1:
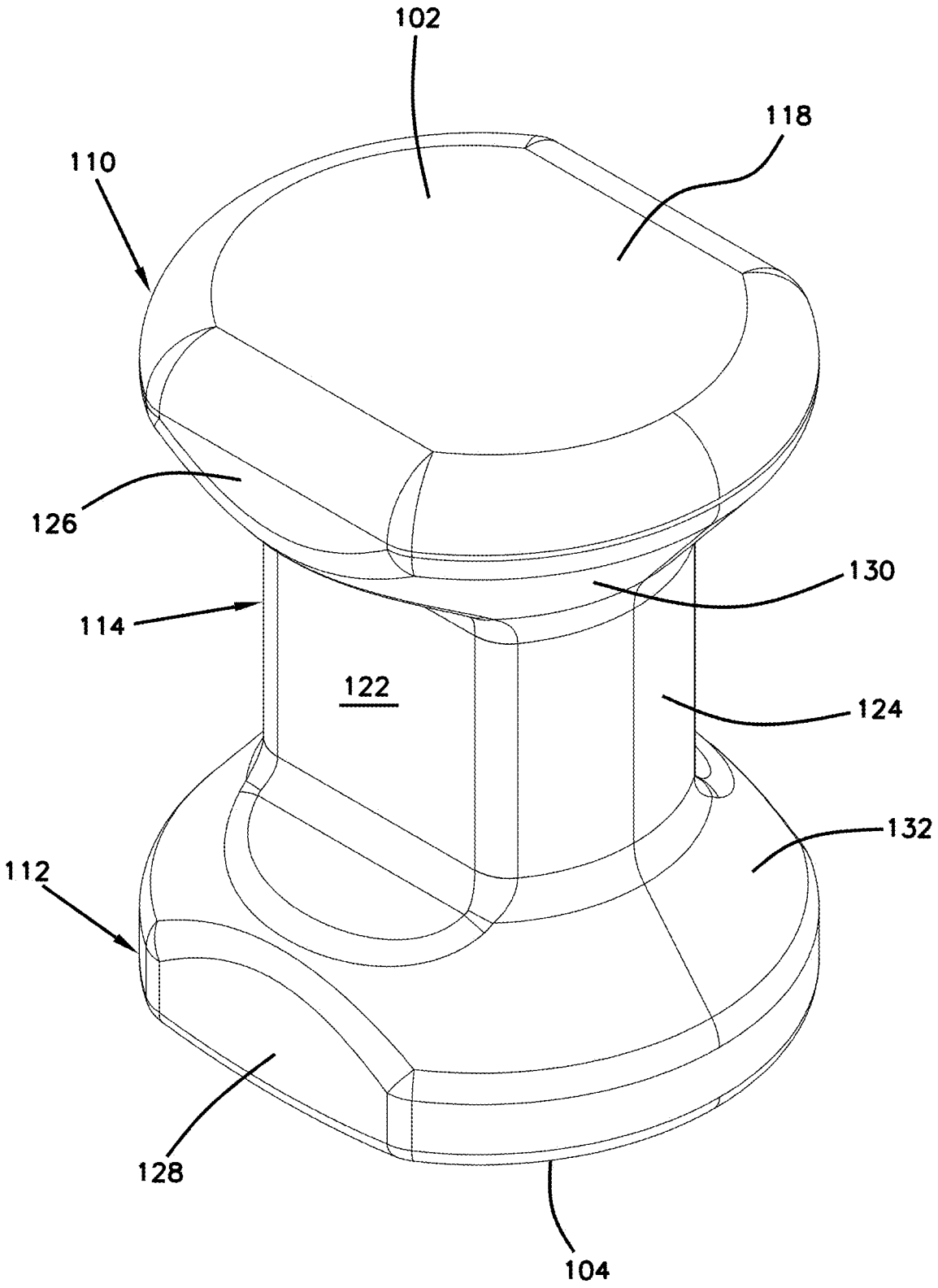
FIG. 1 is top perspective view of an example active seat configured in accordance with the principles of the present disclosure.
Figure 2:
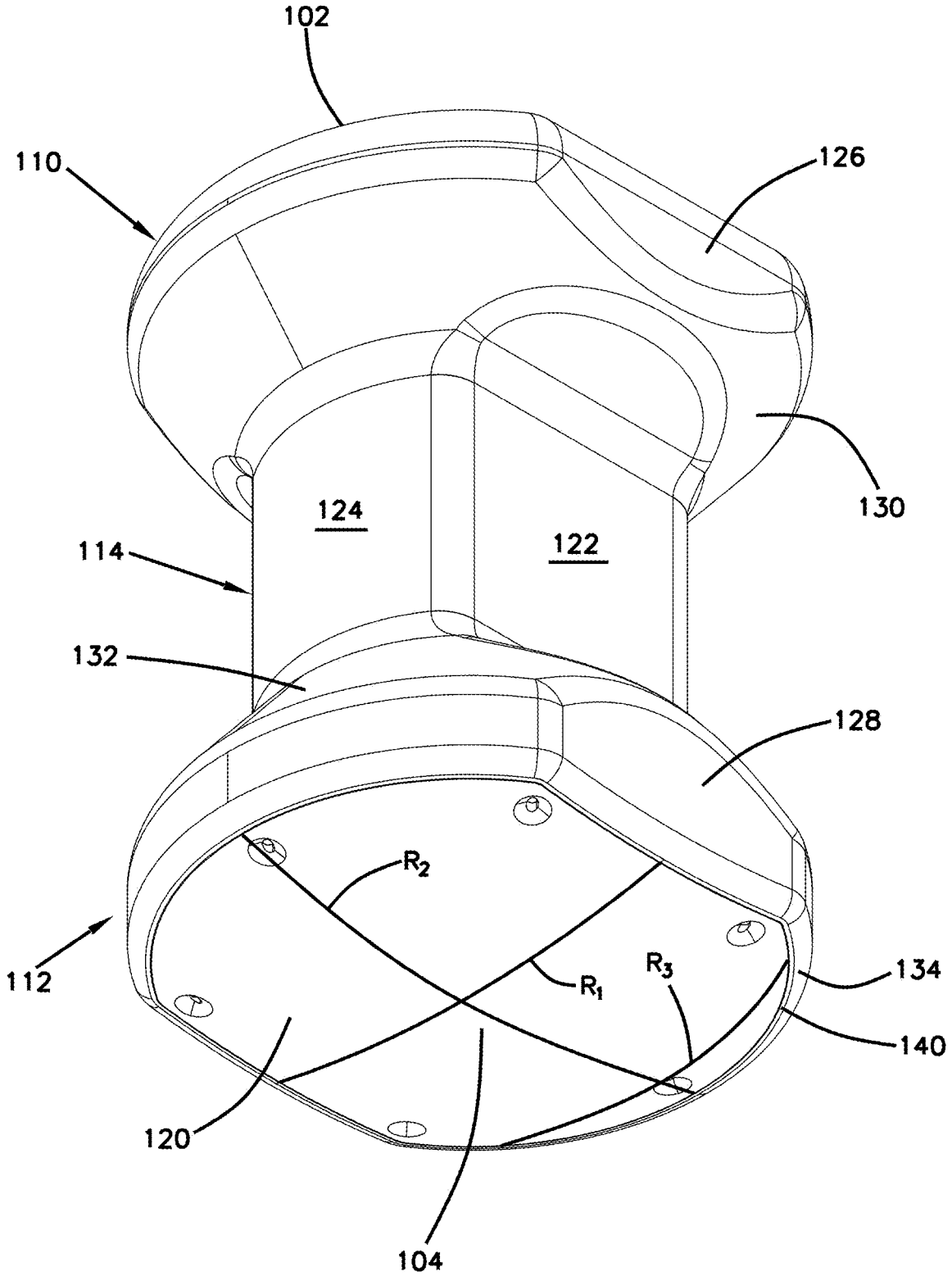
FIG. 2 is bottom perspective view of the active seat of FIG. 1.

Referring to FIGS. 1 and 2, an example active seat 100 extends between a first end 102 and a second end 104. The active seat 100 includes a first end portion 110, a second end portion 112, and a connecting portion 114. The first end portion 110 defines the first end 102 of the active seat and the second end portion 112 defines the second end 104 of the active seat 100.

A seating surface 118 is disposed at the first end portion 110. In some implementations, the seating surface 118 is flat. In other implementations, the seating surface 118 is contoured. In some examples, the seating surface 118 is formed by a depression in the first end portion 110. In other examples, the seating surface 118 has portions raised above the first end portion 110. In the example shown, the seating surface 118 is integral with the first end portion. In other examples, the seating surface 118 may be a separate piece mounted to the first end portion 110. The seating surface 118 faces in a first direction.

A convexly contoured surface 120 is disposed at the second end portion 114. The convexly contoured surface 120 faces in a second direction that is opposite the first direction. The convexly contoured surface 120 defines at least one rocking path R1 along which the active seat 100 can tilt. Tilting the active seat 100 along the rocking path translates the seating surface 118 along a corresponding tilting path T.

In certain implementations, the convexly contoured surface 120 defines multiple rocking paths (e.g., see rocking paths R1, R2, and R3) along which the active seat 100 can be tilted. In some examples, the rocking paths are rotationally offset from each other (e.g., compare rocking paths R1 and R2), thereby allowing a user to rock along different directions (e.g., forward-rearward, side-to-side, etc.). In other examples, the rocking paths are laterally offset from each other (e.g., compare rocking paths R1 and R3), thereby allowing the user to rock back and forth at different lateral tilt angles. For simplicity, three example rocking paths R1, R2, R3 are shown. In an example, the convex surface 112 is oblong. In other examples, the convex surface 112 may have other contoured shapes (e.g., a spherical cap).

Figure 3A:
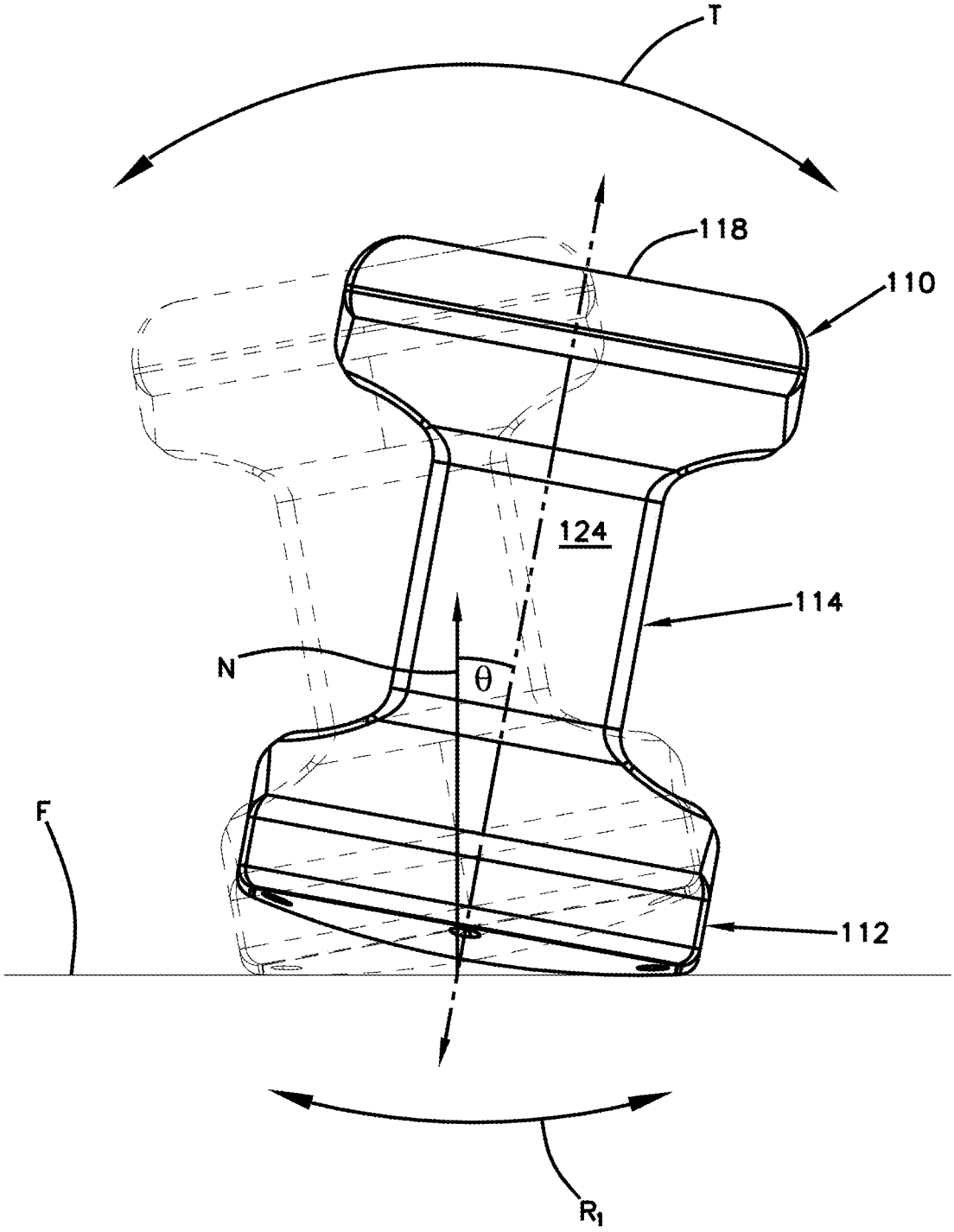
FIG. 3A is a side elevational view of the active seat of FIG. 1 shown in solid lines in a first tilted position along a first example rocking path and in dashed lines in a second tilted position along the first rocking path.
Figure 3B:
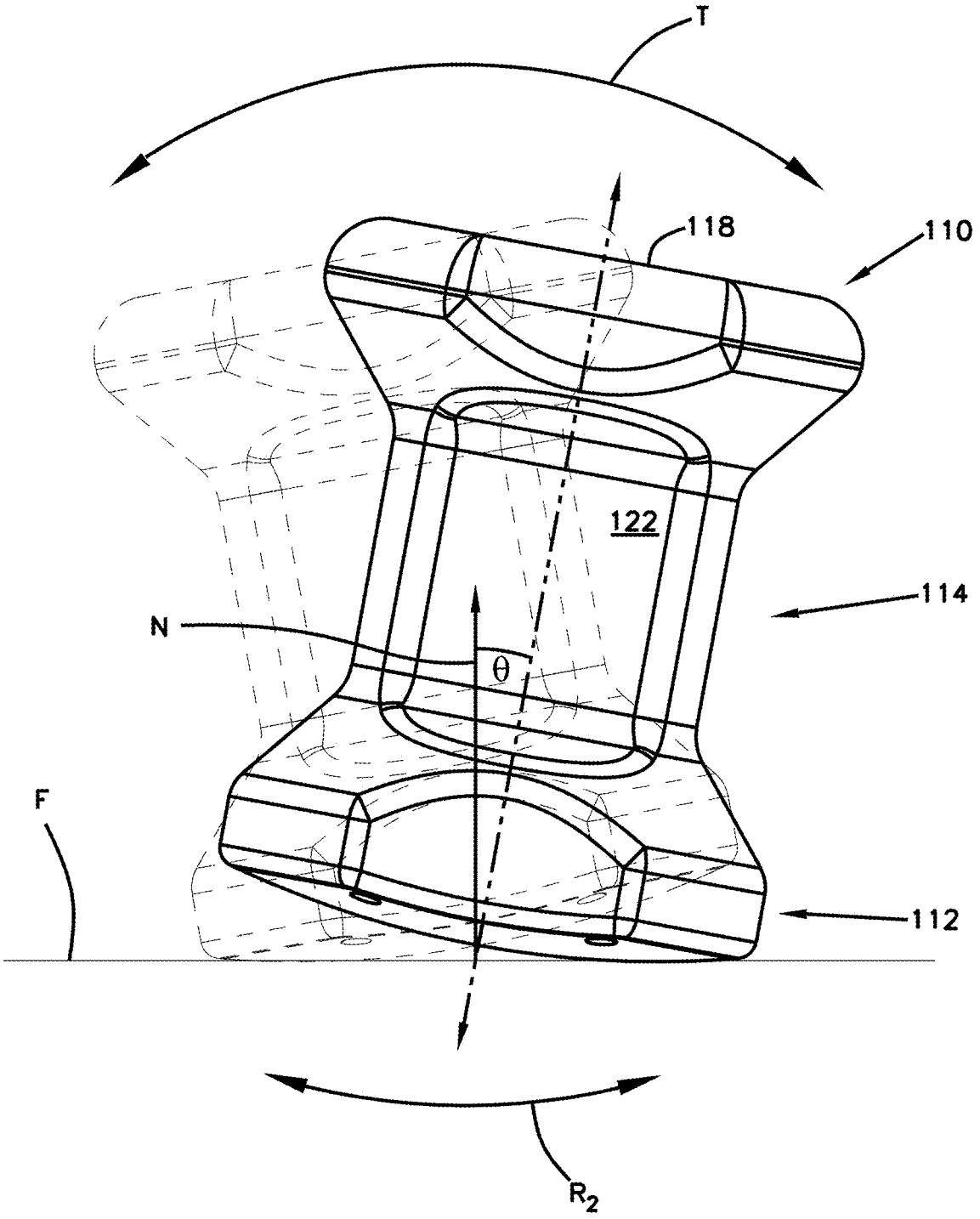
FIG. 3B is a side elevational view of the active seat of FIG. 3A rotated 90 degrees, the active seat being shown in solid lines in a first tilted position along a second example rocking path and in dashed lines in a second tilted position along the second rocking path.

As shown in FIGS. 3A and 3B, as the active seat 100 tilts along a rocking path R1, R2, there is a change in angle θ between the longitudinal axis L of the active seat 100 and a reference axis normal to a floor F on which the stool is disposed. In each of FIGS. 3A and 3B, the active seat 100 is shown in solid lines tilted to a furthermost position along the rocking path R1, R2 in a first direction and is shown in dashed lines tilted to a furthermost position along the rocking path R1, R2 in a second direction that is opposite the first direction. It is noted that the active seat 100 can tilt along any of the rocking paths defined by the convex surface 112.

In certain implementations, the convex surface 120 allows the active seat 100 to tilt up to an angle of 45 degrees in either direction along the rocking path R1. In certain implementations, the convex surface 120 allows the active seat 100 to tilt up to an angle of 40 degrees in either direction along the rocking path R1. In certain implementations, the convex surface 120 allows the active seat 100 to tilt up to an angle of 35 degrees in either direction along the rocking path R1. In certain implementations, the convex surface 120 allows the active seat 100 to tilt up to an angle of 30 degrees in either direction along the rocking path R1. In certain implementations, the convex surface 120 allows the active seat 100 to tilt at an angle of between about 5 degrees and about 45 degrees in either direction along the rocking path R1. In certain implementations, the convex surface 120 allows the active seat 100 to tilt at an angle of between about 10 degrees and about 35 degrees in either direction along the rocking path R1. In certain implementations, the convex surface 120 allows the active seat 100 to tilt at an angle of between about 15 degrees and about 25 degrees in either direction along the rocking path R1.

Figure 4:
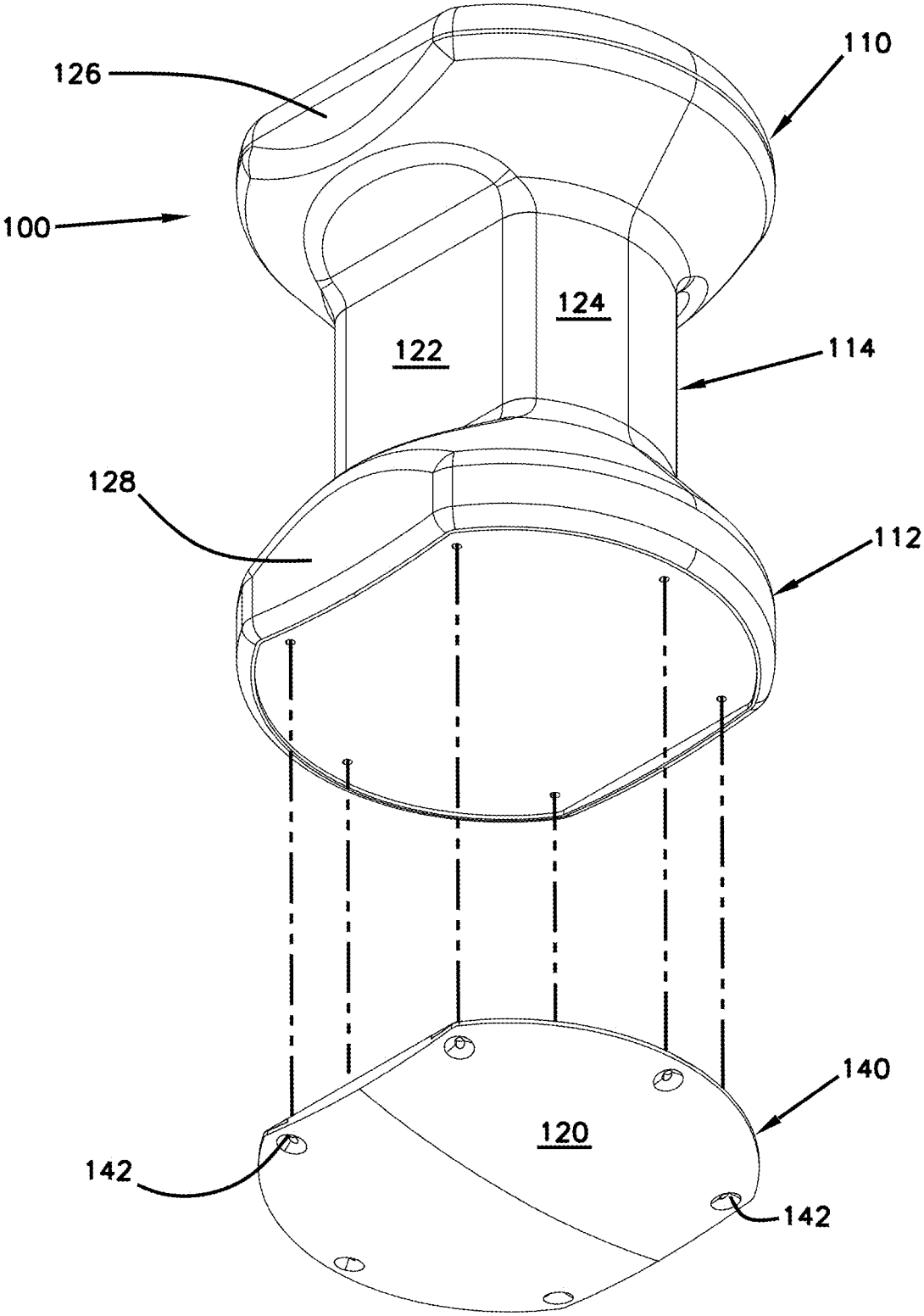
FIG. 4 is a bottom perspective view of the active seat of FIG. 1 with the convex surface illustrated as a separate plate shown exploded from the active seat.

In some implementations, the convex surface 120 is integral with the second end portion 112. In other implementations, the convex surface 120 is a defined by a separate piece 140 that is mounted to the second end portion 112 (e.g., see FIG. 4). For example, the separate piece 140 may define one or more fastener openings 142 through which fasteners (e.g., screws) may be disposed to hold the separate piece 140 to the second end portion 112. In certain examples, the separate piece 140 is formed of a different material (e.g., a more rigid material, a stronger material, a differently textured material, etc.) than the second end portion 112.

In certain examples, a part 134 of the second end portion 112 extends laterally outwardly beyond the convex surface 120. This part 134 provides a stop surface that inhibits further tilting of the active seat 100 along the rocking paths R1, R2, R3. In some examples, the part 134 defines a periphery around the separate piece 140. In other examples, the part 134 is integral with the second end portion 112.

Referring back to FIGS. 1 and 2, the connecting portion 114 extends between the first end portion 110 and the second end portion 112. The connecting portion 114 defines oppositely facing flat surfaces 122. In certain examples, the flat surfaces 122 are connected by oppositely facing side surfaces 124. In the example shown, the side surfaces 124 are convexly curved. In other examples, the side surfaces 124 can be flat or concavely curved.

In certain implementations, the connecting portion 114 has a transverse cross-dimension that is less than a transverse cross-dimension of the first end portion 110 and is less than a transverse cross-dimension of the second end portion 112. In certain examples, any transverse cross-dimension of the connecting portion 114 is less than the corresponding transverse cross-dimensions of the first and second end portions 110, 112. In certain examples, the active seat 100 has an I-shaped profile. In certain examples, the active seat 100 has an I-shaped profile in a first orientation and in a second orientation that is rotated 90 degrees from the first orientation.

In some implementations, the first end portion 110 is shaped the same as the second end portion 112. In other implementations, the first and second end portions 110, 112 are similarly sized and shaped, but are not the same. In certain examples, the first and second end portions 110, 112 contour or taper outwardly as they transition away from the connecting portion 114.

In certain implementations, the active seat 100 is configured to enable multiple active seats be stored in a stack. To stack the active seats 100, a first active seat 100 is flipped 90 degrees to lie sideways on the floor F. In certain examples, the first and second end portions 110, 112 define resting surfaces 126, 128, respectively, that contact the floor F when the active seat 100 is laid sideways on the floor F. In the example shown, the resting surfaces 126, 128 are flat. In other examples, the resting surfaces 126, 128 can be concave or slightly convex. In certain examples, each of the first and second end portions 110, 112 defines oppositely facing resting surfaces 126, 128.

The active seat 100 is oriented on the floor so that one resting surface 126 of the first end portion 110 and one resting surface 128 of the second end portion 112 lie on the floor F. In such an orientation, a first of the flat surfaces 122 faces the floor F and the second flat surface 122 faces away from the floor F. A second active seat 100 is then oriented sideways so that it has a first flat surface 122 aligned with and facing the second flat surface 122 of the first active seat 100. However, the second active seat 100 is rotated 90 degrees relative to the first active seat 100 (e.g., see FIG. 5). Accordingly, the resting surfaces 126, 128 of the second active seat 100 face the floor F, but do not align with the resting surfaces 126, 128 of the first active seat 100.

Figure 6:
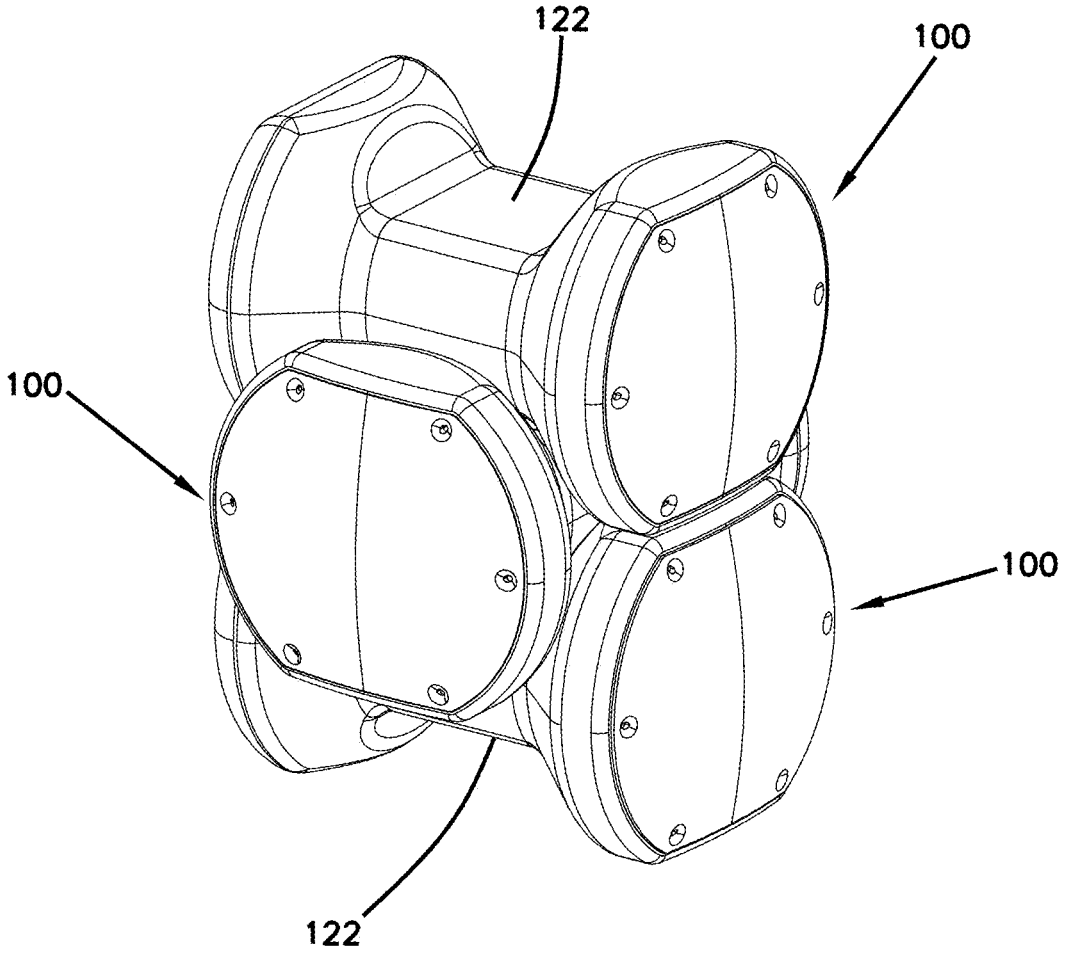
FIG. 6 shows the stack of active seats from FIG. 5 assembled together.

The second active seat 100 is laid over the first active seat 100 so that the first flat surface 122 of the second active seat 100 is supported by the second flat surface 122 of the first active seat 100 (e.g., see FIG. 6). The first and second end portions 110, 112 of the second active seat 100 are rotationally offset from the first and second end portions 110, 112 of the first active seat 100. The first active seat 100 holds the first and second end portions 110, 112 of the second active seat 100 off the ground F.

Figure 5:
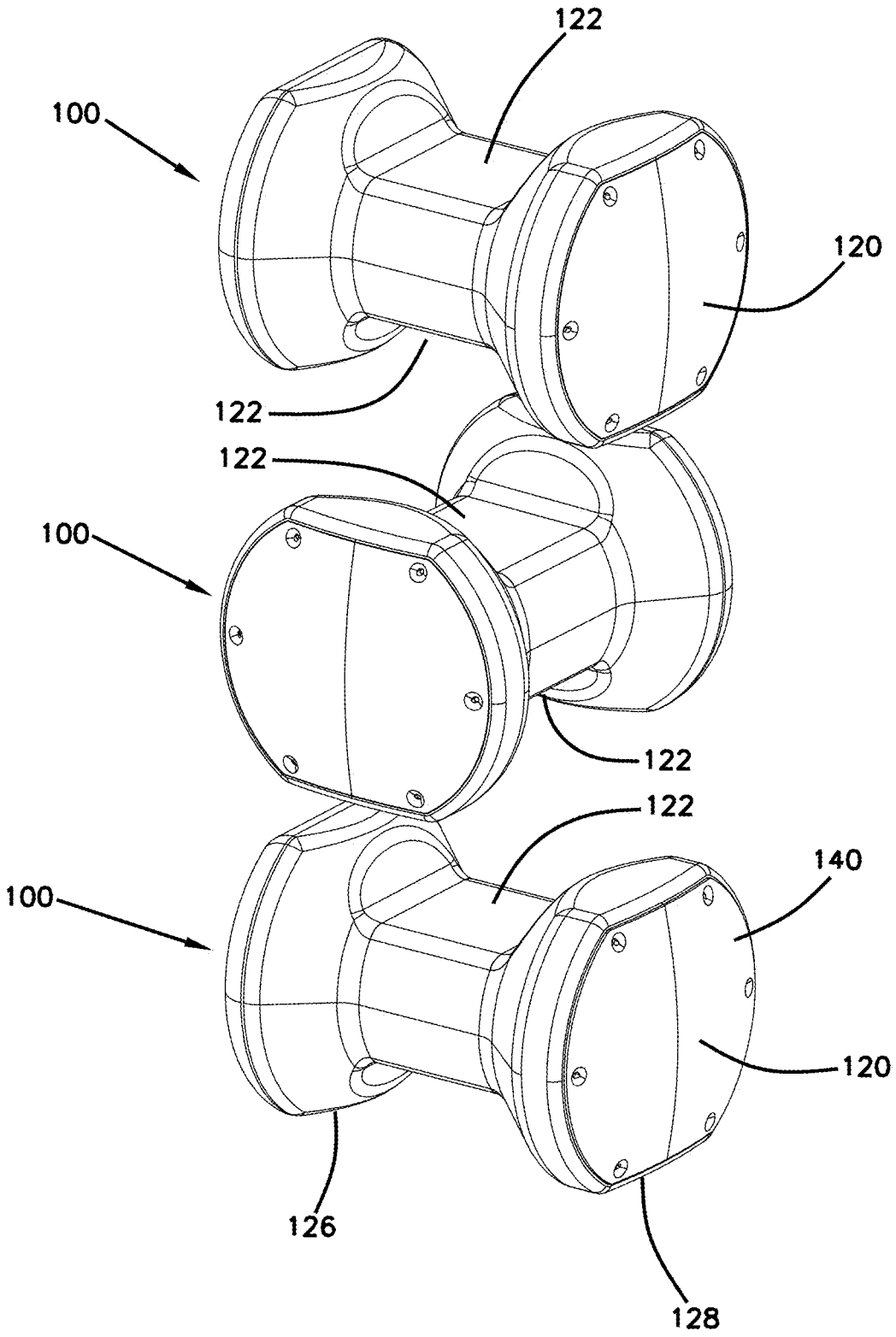
FIG. 5 is a perspective view of a stack of active seats shown exploded from each other for ease in viewing.
Figure 7:
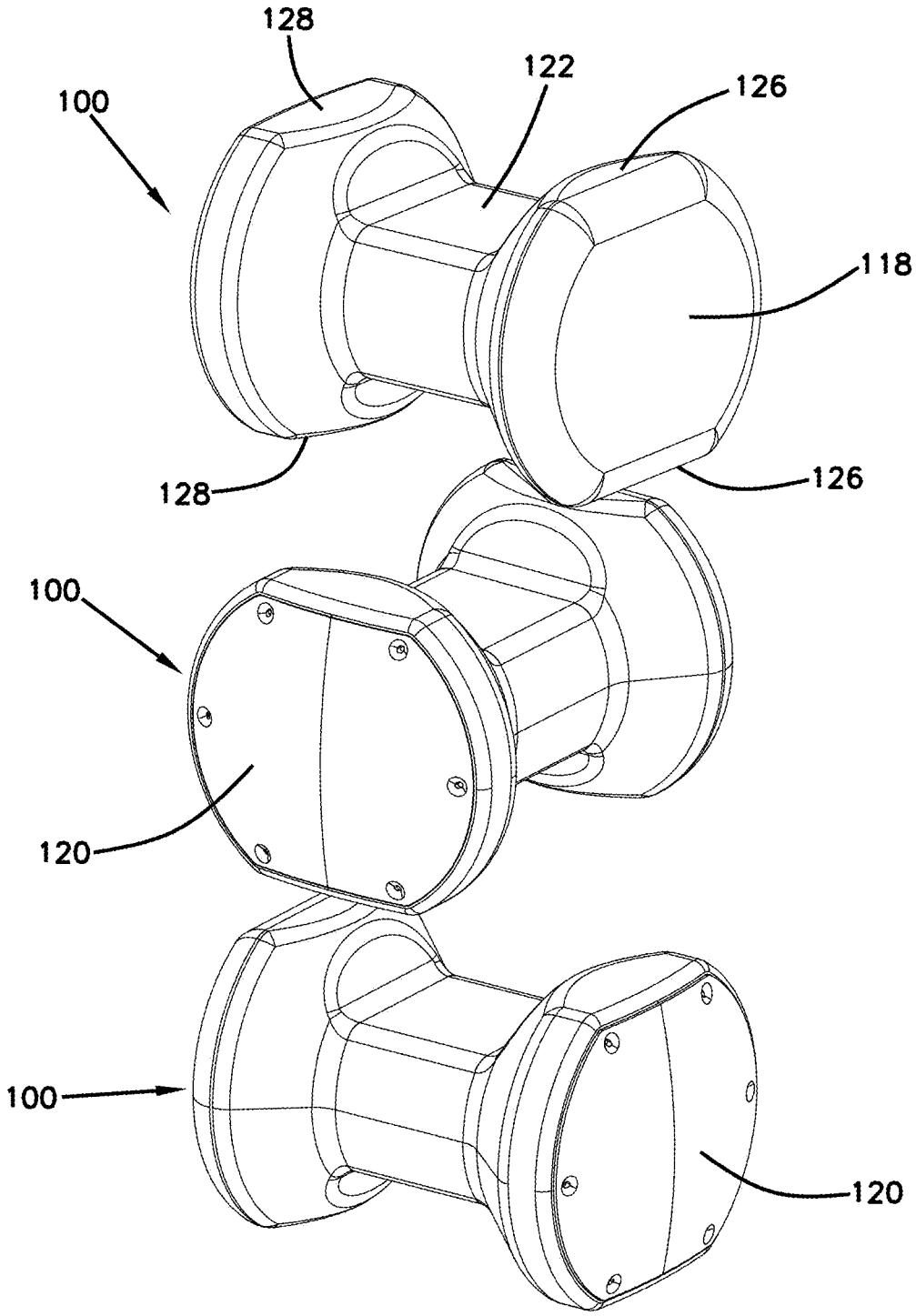
FIG. 7 is a perspective view of the stack of active seats from FIG. 5 showing that one or more active seats in the stack may be flipped in a reverse orientation within the stack.

If a third active seat 100 is added to the stack, the third active seat 100 can have the same orientation as the first active seat 100 (e.g., see FIG. 5) or can be flipped 180 degrees relative to the first active seat 100 (e.g., see FIG. 7). As shown in FIG. 6, downward-facing resting surfaces 126, 128 of the second active seat 100 rest on upward-facing resting surfaces 126, 128 of the first active seat 100. If oriented as shown in FIGS. 5 and 6, then first resting surfaces 126 of the first and second active seats 100 contact each other and second resting surfaces 128 of the first and second active seats 100 contact each other. If oriented as shown in FIG. 7, then a first resting surface 126 of the first active seat 100 contacts a second resting surface 128 of the second active seat 100 and a second resting surface 128 of the first active seat 100 contacts a first resting surface 126 of the second active seat 100.

Having described the preferred aspects and implementations of the present disclosure, modifications and equivalents of the disclosed concepts may readily occur to one skilled in the art. However, it is intended that such modifications and equivalents be included within the scope of the claims which are appended hereto.

What is claimed is:

1. An active seat extending along a central axis between a first end and a second end, the active seat comprising:

a first end portion defining the first end, the first end portion defining a seat facing in a first direction, the seat having a first transverse cross-dimension, and the seat intersecting the central axis, the first end portion also defining oppositely facing first and second resting surfaces, each of the first and second resting surfaces being either flat or concave;

a second end portion defining the second end, wherein a convexly contoured surface is disposed at the second end portion and faces in a second direction opposite the first direction, the convexly contoured surface having a second transverse cross-dimension, and the convexly contoured surface intersecting the central axis, the second end portion also defining oppositely facing third and fourth resting surfaces, each of the third and fourth resting surfaces being either flat or concave; and a connecting portion disposed along the central axis and extending between the first and second end portions, the connecting portion defining oppositely facing flat surfaces connected by oppositely facing side surfaces, the oppositely facing side surfaces being convexly contoured between the oppositely facing flat surfaces, wherein a first of the flat surfaces faces in a common direction with the first and third resting surfaces, the connecting portion having a third transverse cross-dimension that is less than the first transverse cross-dimension and is less than the second transverse cross-dimension.

2. The active seat of claim 1, wherein the convexly contoured surface is shaped to enable rocking of the active seat along a first rocking path.

3. The active seat of claim 1, wherein the convexly contoured surface is shaped to enable rocking of the active seat along multiple rocking paths.

4. The active seat of claim 1, wherein the first transverse cross-dimension substantially matches the second transverse cross-dimension.

5. The active seat of claim 1, wherein the first and third resting surfaces enable the active seat to be laid in a first stable position with the first and third resting surfaces contacting a floor, and wherein the second and fourth resting surfaces enable the active seat to be laid in a second stable position with the second and fourth resting surfaces contacting the floor.

6. The active seat of claim 1, wherein the connecting portion transitions to the first end portion with a taper and transitions to the second end portion with a taper.

7. The active seat of claim 1, wherein the first end portion defines an oblong shape.

8. The active seat of claim 7, wherein the second end portion defines an oblong shape.

9. The active seat of claim 1, wherein the first end portion, the second end portion, and the connecting portion are monolithically formed.

10. The active seat of claim 9, wherein the contoured surface is defined by a plate that is separately mountable to the second end portion, wherein the plate is formed from a different material than the second end portion.

11. The active seat of claim 1, wherein the active seat has an I-shaped profile.

12. An active seat comprising:

a body extending along a length between a first end and a second end;

a seat disposed at the first end of the body, the seat being sized and shaped to enable a user to sit upon the seat;

a convex surface disposed at the second end of the body, the convex surface defining at least a first rocking path about which the active seat tilts, the convex surface being aligned with the seat along the length of the body; and a first stacking notch defined at an intermediate location along the body, the first stacking notch defining a first flat surface extending along part of the length of the body and extending along a width that is transverse to the length of the body, the flat surface being recessed laterally inwardly from an outer periphery of the body taken at the first and second ends; and a second stacking notch is defined at a location laterally aligned with the first stacking notch, the second stacking notch defining a second flat surface extending along part of the length of the body, the second flat surface facing in an opposite direction from the first flat surface, the first and second flat surfaces being separated by a third surface that extends along a thickness of the body that is transverse to the length of the body and transverse to the width of the first flat surface, the thickness of the body being smaller than the width of the first flat surface.

13. The active seat of claim 12, wherein the body defines resting surfaces facing in a common direction with the flat surface, the resting surfaces being disposed towards the first and second ends.

14. An active seat extending along a central axis between a first end and a second end, the active seat comprising:

a first end portion defining the first end, the first end portion defining a seat facing in a first direction, the seat having a first transverse cross-dimension, and the seat intersecting the central axis, the first end portion also defining oppositely facing first and second resting surfaces, each of the first and second resting surfaces being either flat or concave;

a second end portion defining the second end, wherein a convexly contoured surface is disposed at the second end portion and faces in a second direction opposite the first direction, the convexly contoured surface having a second transverse cross-dimension, and the convexly contoured surface intersecting the central axis, the second end portion also defining oppositely facing third and fourth resting surfaces, each of the third and fourth resting surfaces being either flat or concave;

a connecting portion disposed along the central axis and extending between the first and second end portions, wherein the first end portion, the second end portion, and the connecting portion are monolithically formed, the connecting portion defining oppositely facing flat surfaces connected by oppositely facing side surfaces, wherein a first of the flat surfaces faces in a common direction with the first and third resting surfaces, the connecting portion having a third transverse cross-dimension that is less than the first transverse cross-dimension and is less than the second transverse cross-dimension; and a plate separately mountable to the second end portion, wherein the plate is formed from a different material than the second end portion.

15. A stack of active seats comprising:

a first active seat including a first seat portion, a first tilting portion, and a first connecting portion extending between the first seat portion and the first tilting portion, the first connecting portion defining a first flat surface;

a second active seat including a second seat portion, a second tilting portion, and a second connecting portion extending between the second seat portion and the second tilting portion, the second connecting portion defining a second flat surface and another flat surface facing in an opposite direction from the second flat surface;

the second active seat being oriented generally transverse to the first active seat with the second flat surface lying on the first flat surface so that the first active seat supports the second active seat; and a third active seat including a third seat portion, a third tilting portion, and a third connecting portion extending between the third seat portion and the third tilting portion, the third connecting portion defining a third flat surface, the third active seat being oriented generally transverse to the second active seat with the third flat surface lying on the another flat surface of the second active seat so that the second active seat supports the third active seat.

16. The stack of claim 15, wherein the first and second connecting portions define a smallest cross-dimension of the respective first and second active seats.

17. The stack of claim 15, wherein the third active seat is rotated 180 degrees relative to the first active seat.

18. The stack of claim 15, wherein the respective seat portion and the respective tilting portion of each of the first, second, and third active seats includes a pair of oppositely facing resting surfaces, thereby enabling each of the first, second, and third active seats to be independently laid on a floor in either of two stable positions in which the respective tiling portion is offset from the floor.

19. The stack of claim 15, wherein the third active seat has a common orientation with the first active seat.

20. An active seat extending between a first end and a second end, the active seat comprising:

a first end portion defining the first end, the first end portion defining a seat facing in a first direction, the seat having a first transverse cross-dimension;

a second end portion defining the second end, wherein a convexly contoured surface is disposed at the second end portion and faces in a second direction opposite the first direction, the convexly contoured surface having a second transverse cross-dimension, wherein the contoured surface is defined by a plate that is separately mountable to the second end portion, wherein the plate is formed from a different material than the second end portion; and a connecting portion extending between the first and second end portions, the connecting portion defining oppositely facing flat surfaces connected by oppositely facing side surfaces, the connecting portion having a third transverse cross-dimension that is less than the first transverse cross-dimension and is less than the second transverse cross-dimension;

wherein the first end portion, the second end portion, and the connecting portion are monolithically formed.

21. An active seat extending along a central axis between a first end and a second end, the active seat comprising:

a first end portion defining the first end, the first end portion defining a seat facing in a first direction, the seat having a first transverse cross-dimension, and the seat intersecting the central axis, the first end portion also defining oppositely facing first and second resting surfaces, each of the first and second resting surfaces being either flat or concave;

a second end portion defining the second end, wherein a convexly contoured surface is disposed at the second end portion and faces in a second direction opposite the first direction, the convexly contoured surface having a second transverse cross-dimension, and the convexly contoured surface intersecting the central axis, the second end portion also defining oppositely facing third and fourth resting surfaces, each of the third and fourth resting surfaces being either flat or concave; and a connecting portion disposed along the central axis and extending between the first and second end portions, wherein the connecting portion transitions to the first end portion with a taper and transitions to the second end portion with a taper, the connecting portion defining oppositely facing flat surfaces connected by oppositely facing side surfaces, wherein a first of the flat surfaces faces in a common direction with the first and third resting surfaces, the connecting portion having a third transverse cross-dimension that is less than the first transverse cross-dimension and is less than the second transverse cross-dimension.

* * * * *